US006412792B1

(12) United States Patent
Hoskin

(10) Patent No.: US 6,412,792 B1
(45) **Date of Patent: *Jul. 2, 2002**

(54) BRAKING SYSTEM FOR IN-LINE SKATES

(76) Inventor: Robert F. Hoskin, 3885 Berkeley View Dr., Duluth, GA (US) 30136-3084

( * ) Notice: Subject to any disclaimer, the term of this patent is extended or adjusted under 35 U.S.C. 154(b) by 0 days.

This patent is subject to a terminal disclaimer.

(21) Appl. No.: 09/519,907

(22) Filed: Mar. 7, 2000

Related U.S. Application Data

(63) Continuation of application No. 08/942,134, filed on Oct. 1, 1997, now Pat. No. 6,039,330, which is a continuation-in-part of application No. 08/620,675, filed on Mar. 26, 1996, now Pat. No. 6,010,136.

(51) Int. Cl.[7] ..... A63C 17/14

(52) U.S. Cl. ..... 280/11.204; 280/11.211; 280/11.214

(58) Field of Search ..... 280/11.204, 11.211, 280/11.212, 11.214, 11.215; 188/5, 29, 25, 264 R

(56) References Cited

U.S. PATENT DOCUMENTS

| | | | | | |
|---|---|---|---|---|---|
| 926,646 | A | * | 6/1909 | Eubank, Jr. | 280/11.214 |
| 4,526,389 | A | * | 7/1985 | Chase | 280/11.21 |
| 5,411,276 | A | * | 5/1995 | Moldenhauer | 280/11.2 |
| 5,511,805 | A | * | 4/1996 | McGrath | 280/11.2 |
| 5,630,596 | A | * | 5/1997 | Rudolph | 280/11.2 |
| 5,755,449 | A | * | 5/1998 | Pozzobon | 280/11.2 |
| 5,868,404 | A | * | 2/1999 | Montague | 280/11.2 |
| 5,924,704 | A | * | 7/1999 | Johnson | 280/11.2 |
| 6,010,136 | A | * | 1/2000 | Hoskin | 280/11.2 |
| 6,039,330 | A | * | 3/2000 | Hoskin | 280/11.2 |

* cited by examiner

*Primary Examiner*—Brian L. Johnson
*Assistant Examiner*—Bridget Avery
(74) *Attorney, Agent, or Firm*—Alston & Bird LLP

(57) ABSTRACT

Apparatus and method for simultaneously applying braking forces to two spaced apart rotating in-line roller skate wheel assemblies.

32 Claims, 4 Drawing Sheets

BRAKING SYSTEM FOR IN-LINE SKATES

CROSS-REFERENCE TO RELATED APPLICATIONS

This application is a continuation of my application Ser. No. 08/942,134, filed Oct. 1, 1997, entitled "BRAKING SYSTEM FOR IN-LINE SKATES.", which issued as U.S. Pat. No. 6,039,330, which itself is a continuation-in-part of my prior application Ser. No. 08/620,675, filed Mar. 26, 1996, entitled "BRAKING SYSTEM AND METHOD", and which issued as U.S. Pat. No. 6,010,136.

BACKGROUND OF THE INVENTION

This invention relates generally to braking systems for in-line skates and more particularly to high heat transfer braking systems capable of simultaneously applying braking forces to multiple skate wheels.

In-line roller skates such as that disclosed in U.S. Pat. No. 5,028,058 to B. J. Olson have become increasingly popular for fitness, recreational, and competitive skating. The in-line roller skates enable skaters to achieve high skating speeds, particularly when skating outdoors on hilly terrain. A number of prior art braking devices have become available in an attempt to provide brakes which develop substantial braking forces that are required for safe operation under such conditions. Examples of various prior art brakes are illustrated in the following patents:

| Patent No. | Issue Date | Inventor | Class/Subclass |
|---|---|---|---|
| 1,402,010 | 1/1922 | Ormiston | 280/11.2 |
| 1,956,433 | 4/1934 | Young | 188/77 |
| 3,224,785 | 12/1965 | Stevenson | 280/11.2 |
| 3,811,542 | 5/1974 | Hamrick et al. | 188/259 |
| 3,828,895 | 8/1974 | Boaz | 188/77R |
| 4,033,433 | 7/1977 | Kirk | 188/25 |
| 4,275,895 | 6/1981 | Edwards | 280/11.2 |
| 4,943,072 | 7/1990 | Henig | 280/11.2 |
| 5,183,275 | 2/1993 | Hoskin | 280/11.2 |
| 5,226,673 | 7/1993 | Cech | 280/11.2 |
| 5,351,974 | 10/1994 | Cech | 280/11.2 |
| 5,375,859 | 12/1994 | Peck et al. | 280/11.2 |
| 5,388,844 | 2/1995 | Pellegrini et al. | 280/11.2 |
| 5,411,276 | 5/1995 | Moldenhauer | 280/11.2 |
| 5,511,805 | 4/1996 | McGrath | 280/11.2 |

U.S. Pat. No. 5,411,276 applies braking forces to two adjacent wheels on an in-line skate using two different braking rollers with each braking roller contacting a different skate wheel. Each of the braking rollers has a brake pad applied to the surface of the braking roller which also contacts the skate wheel surface. The net result is that the heated surface of the braking roller contacts the skate wheel surface to overheat skate wheel during heavy brake usage and one of the skate wheels being braked can stop turning without the other skate wheel stopping to not only reduce the braking efficiency of the braking of the skate but also cause uneven wearing of the skate wheels.

U.S. Pat. No. 5,511,805 is not a braking device that is user applied, but rather, is used to retard the turning of the skate wheels while the user is learning to skate. Additional conventional braking devices are used to actually stop the skate.

The other prior art braking devices apply the braking forces to a single rotating member. First of all, this limits the amount of braking forces that can be applied to the skate. Secondly, the heat generated by the braking device is typically absorbed in the braking device itself which heats the skate wheel because of the contact between the skate wheel and the braking device. Because relatively large amounts of heat are generated and because the skate wheels are usually made of a resilient elastomer material, these prior art braking devices frequently damaged the skate wheel against which the braking forces were applied. Moreover, the limited he at dissipation achieved with these prior art systems contributed to increased wear of the braking device itself. As a result, the prior art has not been able to adequately brake in-line roller skates.

SUMMARY OF THE INVENTION

These and other problems and disadvantages associated with the prior art are overcome by the invention disclosed herein by providing a braking system for in-line roller skates which is capable of applying large magnitude braking forces to the skate wheel assemblies without excessive wear to the brake pad and/or the skate wheel assemblies, which distributes the braking forces equally between at least a pair of the skate wheel assemblies to effectively reduce the per wheel stopping forces required to stop the in-line roller skate, and which isolates the heat generated by braking from the skate wheel assemblies so as to prevent excessive wear and/or damage thereto. The invention also reduces the vibrations transmitted to the wearer through the skates, permits greater control over the application of the braking forces by the user, and automatically varies the contact force between the roller skate wheel assembly and the brake proportional to the magnitude of the braking forces being generated to provide improved safety of operation.

The invention is directed to a braking system for applying braking forces to a pair of adjacent rotating skate wheel assemblies on in-line roller skates, and can be applied to both pneumatic and elastomeric type skate wheel assemblies. The invention also is directed to a braking method which lends itself to the braking of in-line roller skates and to the cooling of the member used to apply the braking forces to the skate wheel assemblies.

The braking system of the invention simultaneously engages a pair of spaced apart skate wheel assemblies on an in-line roller skate and includes an engaging assembly for engaging the rotating skate wheel assemblies, mounting means for mounting the engaging assembly adjacent the rotating skate wheel assemblies, braking means for applying braking forces to the engaging assembly, and actuation means for causing the engaging assembly to engage the periphery of the rotating skate wheel assemblies while the braking means applies braking forces to the engaging assembly to brake the rotation of the skate wheel assemblies. Limit means is provided for preventing the engaging assembly from passing between the skate wheel assemblies.

The engaging assembly defines a peripheral engaging surface therearound having a diameter greater than the minimum distance between the peripheries of the rotating skate wheel assemblies. The engaging surface is adapted to frictionally engage the peripheries of the rotating skate wheel assemblies so that the engaging assembly is rotated by the skate wheel assemblies while engaged. The engaging assembly may include a thermally conductive cylindrical brake drum with an annular transfer section around the brake drum connected to the brake drum through a thermal resistance section for thermally isolating the transfer section from the heat generated in the brake drum by the frictional interface between the brake drum and the braking means.

The mounting means mounts the engaging assembly adjacent the peripheries of the skate wheel assemblies so that the engaging assembly is free to move a limited distance toward and away from both of the rotating skate wheel assemblies for engagement therewith while rotating about its central axis, while having its central axis maintained generally parallel to the rotational axes of the skate wheel assemblies, and while keeping the engaging assembly laterally aligned with the skate wheel assemblies. The mounting means comprises a leaf mounting assembly carried between the skate side frames and rotatably mounting the engaging assembly thereon. The leaf mounting assembly may include at least one and preferably two elongate leaf members flexible in a first direction and substantially inflexible in a second direction normal to the first direction where the leaf members are mounted so that the second direction is oriented substantially parallel to the axes of rotation of the skate wheel assemblies, and where the engaging assembly is rotatably mounted on the leaf members so that the leaf members can flex to allow the engaging assembly to move toward and away from the peripheries of the skate wheel assemblies but the engaging assembly is maintained laterally of the rotating members. A thrust bearing washer may be positioned between the sides of the transfer section around the brake drum and the adjacent sides of the braking means to reduce friction.

The actuation means selectively forces the engaging assembly toward the pair of skate wheel assemblies so that the contact forces between the engaging assembly and the skate wheel assemblies are substantially equalized. The actuating means may be operated by the pivotal cuff on the skate shoe.

The braking means for the engaging assembly may include arcuate brake pad means for frictionally engaging the cylindrical brake pad engaging surface on the engaging assembly. The brake pad means is mounted on the mounting means. The actuation means and the mounting means may be constructed and arranged to selectively cause the brake pad means to frictionally engage the engaging assembly while simultaneously forcing the engaging assembly against the peripheries of the skate wheel assemblies to brake same.

The limit means is mounted between the side frames on the skate to physically limit the movement of the engaging assembly so as to keep the engaging assembly from passing between the adjacent skate wheel assemblies being braked. The limit means may include a limit roller rotatably mounted between the skate side frames so that the engaging assembly can continue to rotate when the limit means is engaged to continue to apply braking forces to the skate wheel assemblies. When used with pneumatic tired skate wheel assemblies, the limit roller may be located so as to cause the engaging assembly to continue to provide braking forces to the underflated skate wheel assembly in the event one of the tires becomes deflated.

The braking method of the invention comprises the steps of rotatably positioning an engaging member between the skate wheel assemblies so that the engaging member is in peripheral contact with both skate wheel assemblies; restraining the engaging member so that the engaging member is maintained in lateral alignment with the rotating skate wheel assemblies while being free to move toward and away from the rotating members; moving the engaging member toward the skate wheel assemblies so that the engaging member exerts approximately equal forces on the skate wheel assemblies; and, applying braking forces to the engaging member to resist the rotation thereof so that approximately equally divided braking forces are applied to the skate wheel assemblies. The braking method may further comprise the step of cooling the engaging member to prevent heat buildup in the engaging member during braking so as to deleteriously affect the skate wheel assemblies.

These and other features and advantages of the invention will become more clearly understood upon consideration of the following detailed description and accompanying drawings wherein like characters of reference designate corresponding parts throughout the several views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 1:
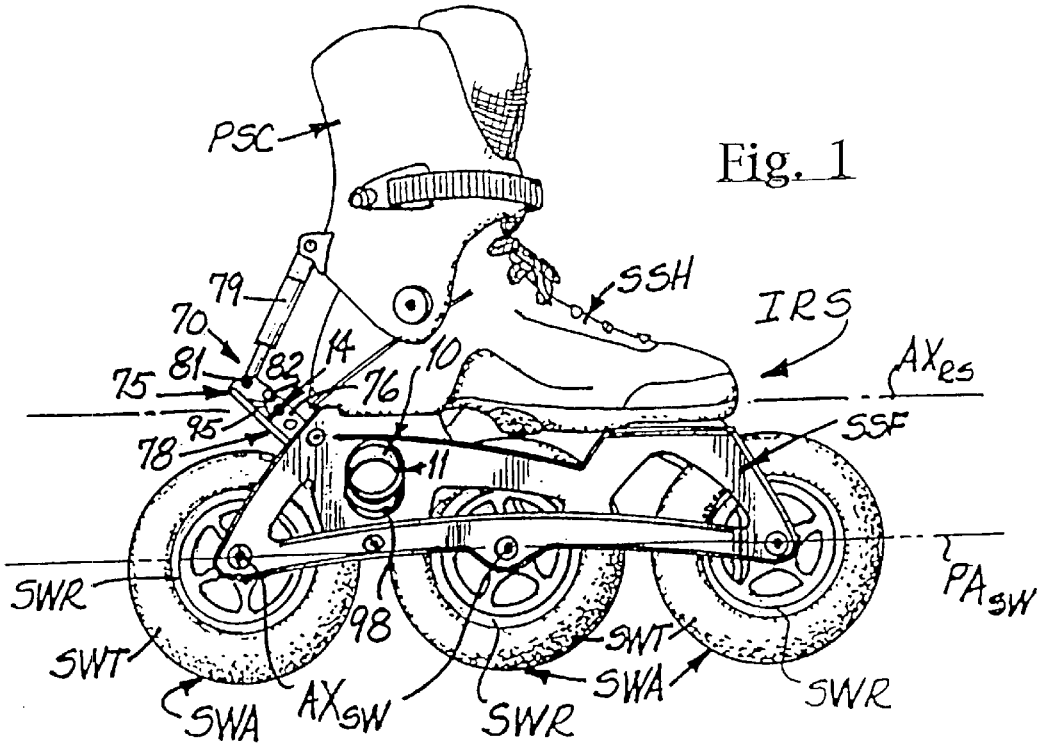
FIG. 1 is a right side perspective of an in-line roller skate embodying the invention.
Figure 3:
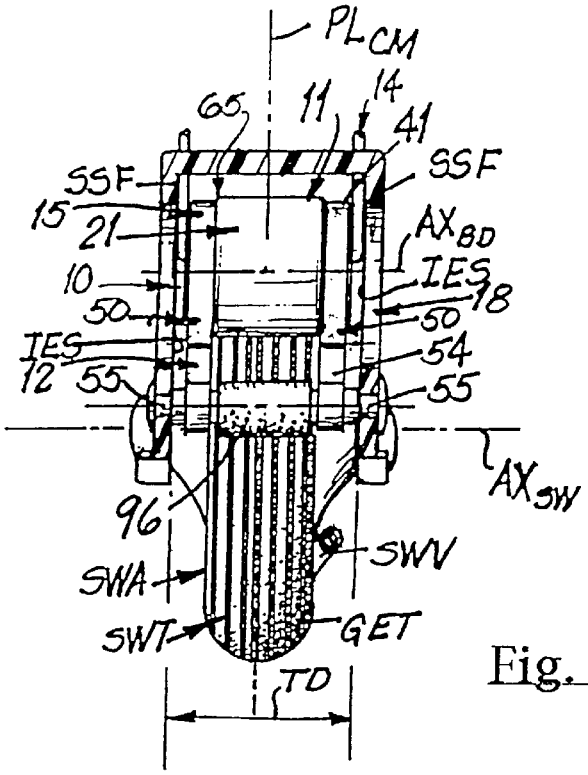
FIG. 3 is a vertical cross-sectional view taken generally along line 3—3 in FIG. 2.
Figure 2:
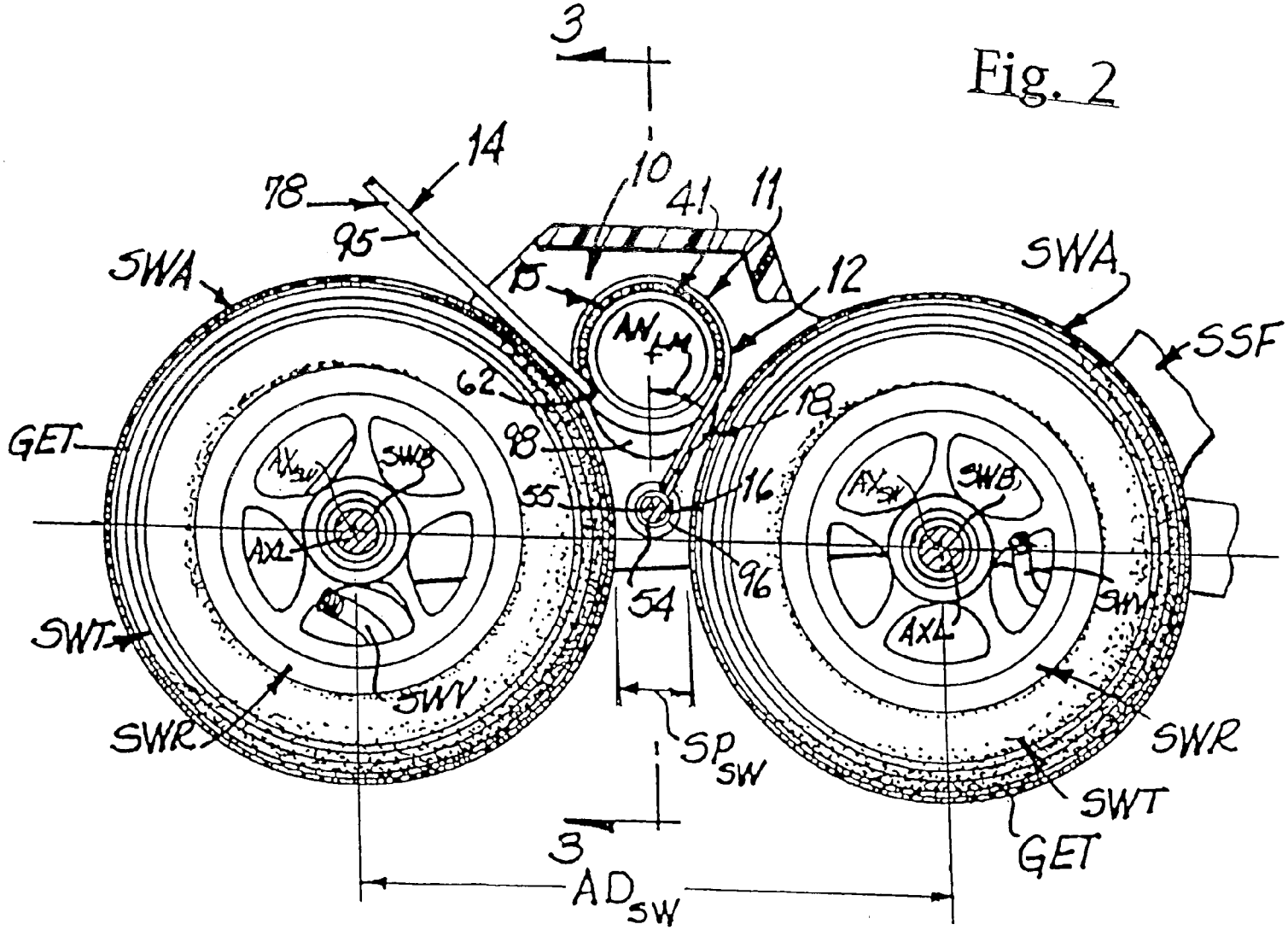
FIG. 2 is an enlarged longitudinally extending vertical cross-sectional view taken just inside the right skate side frame.

As best seen in FIGS. 1–3, the invention disclosed is directed to a braking system 10 for in-line roller skates IRS which equalizes the braking forces exerted against a pair of spaced apart skate wheel assemblies SWA on the skate and which provides for cooling that part of the braking system contacting the skate wheel assemblies to prevent overheating the skate wheel assemblies. The braking system 10 is described as being applied to an in-line roller skate IRS with pneumatic tires SWT designed for off-road use but may be applied to any in-line roller skate as more fully set forth in my copending application Ser. No. 08/620,675 incorporated herein by reference.

As best seen in the FIGS. 1–3, the braking system 10 is applied to an off-road type in-line roller skate IRS. The skate IRS has a pair of side frames SSF mounted on the bottom of the skate shoe SSH. A plurality of skate wheel assemblies SWA are rotatably mounted between the side frames SSF at axially spaced apart positions along a common path $PA_{SW}$ (FIG. 1) lying in a vertical plane $PL_{CM}$ (FIG. 3) in which the skate longitudinal axis $AX_{RS}$ (FIG. 1) also lies. The skate wheel assemblies SWA rotate about axes $AX_{SW}$ normal to the plane $PL_{CM}$ and spaced apart an axle distance $AD_{SW}$ (FIG. 2).

As best seen in FIG. 2, each of the skate wheel assemblies SWA includes a rim assembly SWR rotatably mounted on an axle AXL extending between the side frames SSF on appropriate bearings SWB as is known in the art. A pneumatic tire SWT is mounted on the rim assembly SWR and provided with a ground engaging tread GET on which the skate rolls. Appropriate fill valves SWV are provided on the rim assembly SWR to inflate the tires SWT. The skate wheel assemblies SWA are significantly larger than the skate wheel assemblies typically used with on-road type in-line roller skates, being typically in the order of six inches in diameter. It is to be understood, however, that the braking system 10 can be applied to either on-road or off-road type in-line roller skates without departing from the scope of the invention. Likewise, it is to be understood that the tires SWT may be solid foam type tires rather than pneumatic without departing from the scope of the invention.

As best seen in FIGS. 2 and 3, the braking system 10 includes an engaging assembly 11 frictionally engaging the tire treads GET of the skate wheel assemblies SWA; mounting means 12 mounting the engaging assembly 11 adjacent the tire treads of the skate wheel assemblies SWA so that the engaging assembly 11 is free to move a limited distance toward and away from both of the skate wheel assemblies SWA; and actuation means 14 for selectively forcing the engaging assembly 11 toward the pair of rotating skate wheel assemblies SWA so that the contact forces between the engaging assembly 11 and the skate wheel assemblies SWA are substantially equalized. The braking system 10 also includes braking means 15 for applying a braking force to the engaging assembly 11 so that the engaging assembly retards the rotation of the skate wheel assemblies SWA when the actuation means 14 forces the engaging assembly 11 against the skate wheel assemblies SWA. The braking system 10 also includes limit means 16 which physically prevents the engaging assembly 11 from passing between the skate wheel assemblies SWA even if one of the tires SWT becomes deflated while at the same time insuring that the engaging assembly 11 still will apply braking forces to the remaining inflated tire SWT. Further, the braking system 10 may also include temperature control means 18 for preventing overheating of the engaging assembly 11 or the skate wheel assemblies SWA due to the heat generated by the braking process.

Figure 4:
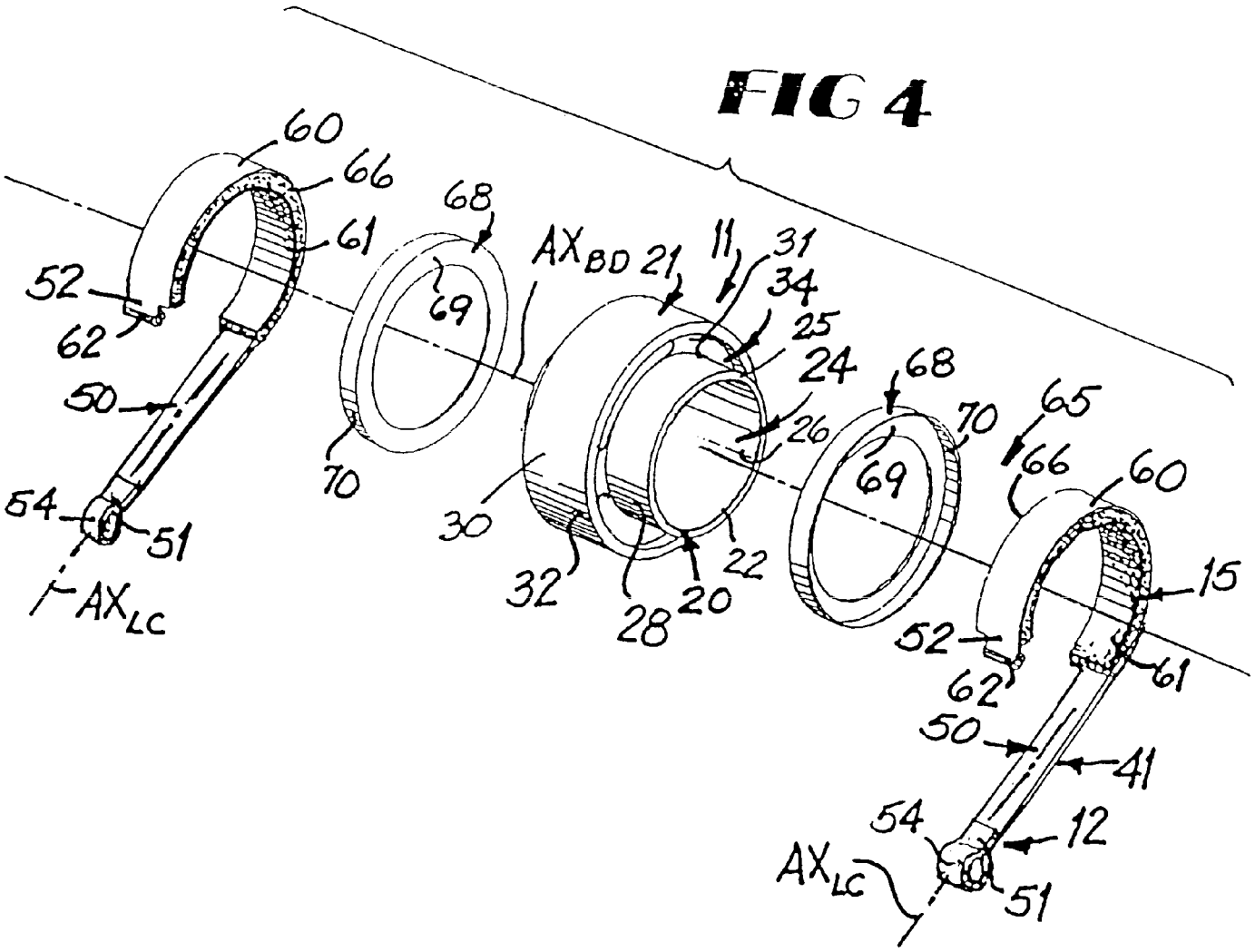
FIG. 4 is an enlarged exploded perspective view of the engaging assembly and braking means of the invention.
Figure 5:
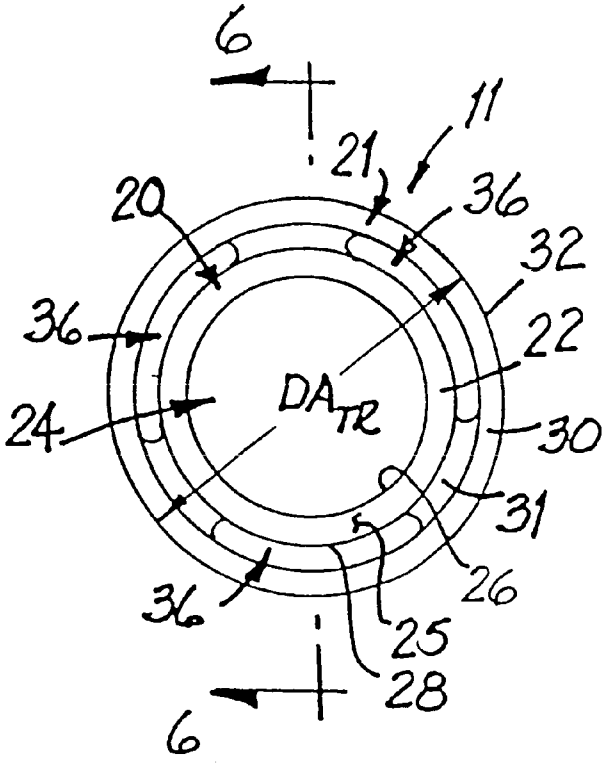
FIG. 5 is an enlarged end view of the engaging assembly of the invention; and, FIG. 6 is a cross-sectional view taken along line 6—6 in FIG. 5.
Figure 6:
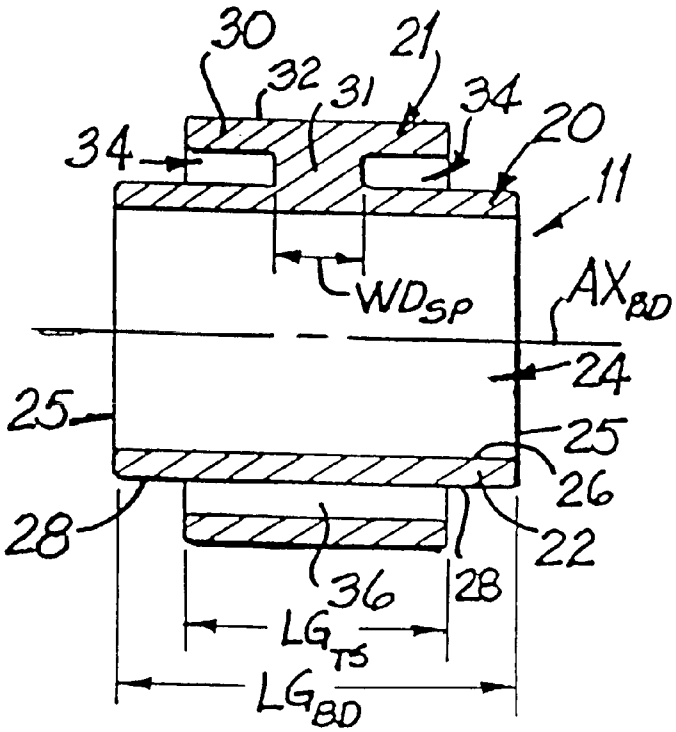

As seen in FIGS. 4–6, the engaging assembly 11 includes a cylindrical tubular brake drum 20 around which is formed an enlarged diameter transfer section 21. The enlarged diameter transfer section 21 may be integral with the drum 20 as illustrated herein or a separate member attached to the drum 20 as disclosed in my copending application Ser. No. 08/620,675. The brake drum 20 is designed to have the braking forces applied thereto by the braking means 15 and is movably mounted by the mounting means 12 adjacent the pair of skate wheel assemblies SWA. The transfer section 21 projects out around the outside of the brake drum 20 at a position intermediate its length.

The brake drum 20 has an annular side wall 22 defining a central axially extending passage 24 therethrough about the longitudinally extending axis $AX_{BD}$ of the drum. Opposite ends of the brake drum 20 are oriented normal to the brake drum axis $AX_{BD}$ to define opposed end side engaging surfaces 25 thereon. The brake drum 20 has a prescribed length $L_{BD}$ (FIG. 6) which is slightly less than the transverse distance TD (FIG. 3) between the skate side frames SSF as will become more apparent so that the brake drum 20 will freely pass between the side frames SSF while being oriented so that its central axis $AX_{BD}$ is generally horizontal and normal to the skate longitudinal axis $AX_{RS}$ and the plane $PL_{CM}$. The brake drum 20 is preferably heat conductive so that it will transfer heat therethrough to the inside peripheral surface 26 of the side wall 22. The outside peripheral surface on the drum side wall 22 serves as a base from which the transfer section 21 is mounted.

The transfer section 21 has a length $LG_{TS}$ (FIG. 6) less that of the brake drum side wall 22 and is located midway the length of the side wall so that a pair of cylindrical brake pad engaging surfaces 28 are defined on opposite ends of the outside peripheral surface of the drum side wall 22 outboard of the transfer section 21. These surfaces 28 are concentric of the drum central axis $AX_{BD}$ and centered on a plane normal to the drum central axis $AX_{BD}$. These surfaces 28 are frictionally engaged by the braking means 15 to apply braking forces to the engaging assembly 11 and retard its rotation as will become more apparent. As will also become more apparent, a significant amount of the heat generated at the braking means 15/brake pad engaging surfaces 28 interface is transferred through the side wall 22 to the inside surface 26 of the side wall 22. While any convenient material may be used for the brake drum 20, steel as well as metal matrix/refractory ceramic composites have been used satisfactorily to provide the necessary strength to support the forces to which the side wall 22 is exposed, conduct the heat from the surfaces 28 through the side wall 22 to the inside surface 26, and not excessively wear when the frictional braking forces are applied to the surfaces 28.

The transfer section 21 is an annular cylindrical portion 30 joined to the brake drum side wall 22 through a reduced width spacer portion 31 so that the section 21 will be maintained concentrically of the brake drum central axis $AX_{BD}$ with the section 21 centered on a plane normal to the drum central axis $A_{BD}$. The transfer section 21 has an outside diameter $DA_{TR}$ (FIG. 5) which is greater than the clearance space $SP_{SW}$ (FIG. 2) between the adjacent skate wheel assemblies SWA so that the engaging assembly will not pass down between the skate wheel assemblies SWA when the tires SWT are inflated but rather will engage the tire treads GET of the two skate wheel assemblies.

The spacer portion 31 of the transfer section 21 connects the section 21 to the brake drum 20 and has a width $WD_{SP}$ (FIG. 6) much less than the length $LG_{TS}$ of the transfer section 21. As best seen in FIG. 5, the spacer portion 31 also has openings 36 therethrough to further reduce the net cross-sectional area through which heat can be conducted from the drum 20 to the transfer section 21. It will thus be seen that the spacer portion 31 acts as a resistance to the transfer of heat generated by the braking action to the transfer section 21 so as to minimize the heat transferred to the skate wheel tires SWT. The spacer section 31 is centered under the transfer section 21 so that a pair of annular recesses 34 are defined on opposite ends of the section 21.

The mounting means 12 includes a leaf mounting assembly 41 best seen in FIGS. 2–4 mounted between the skate side frames SSF in the space between the two skate wheel assemblies SWA which are to be engaged by the engaging assembly 11. The engaging assembly 11 is mounted by the leaf mounting assembly 41 between the skate side frames SSF above path $PA_{SW}$ along which the skate wheel assemblies SWA are centered.

The leaf mounting assembly 41 and braking means 15 best seen in FIG. 4 are combined so as to both position the engaging assembly 11 and also apply braking forces thereto. The leaf mounting assembly 41 includes a pair of elongate flat resilient leaf members 50 which can be resiliently flexed easily in one plane but not in the other.

Each of the leaf members 50 has a transverse width slightly less than the distance the end of the brake drum 20 projects out past the transfer section 21 so that, when the leaf member 50 is oriented parallel to the skate side frames SSF and adjacent one of them, the leaf member 50 will just clear the end edge of the transfer section 21. Each leaf member 50 has a connector end 51 and a projecting pad support end 52.

The connector end 51 of each leaf member is provided with a connector loop 54. The connector loop 54 is pivotally mounted on a pivot pin 55 extending between the opposed skate side frames SSF below the path $PA_{SW}$ along which the skate wheel assembly axes lie and generally centered longitudinally between the skate wheel assemblies SWA being braked. The leaf members 50 angle upwardly at an angle $AN_{LM}$ of about 30–40° from the vertical illustrated in FIG. 2. This locates the leaf members 50 adjacent the skate side frames SSF so as to provide clearance for the skate wheel tires SWT and the transfer section 21 on the engaging assembly 11. The leaf members 50 are oriented so that their longitudinal centerlines $AX_{LC}$ seen in FIG. 4 can move in a vertical plane as the leaf members flex but lateral movement of the leaf members is substantially precluded so that movement of the centerlines $AX_{LC}$ away from the vertical plane $PL_{CM}$ is substantially prevented. As will become more apparent, this helps keep the engaging assembly 11 in lateral registration with the skate wheel tire treads GET and centered between the side frames SSF on the roller skate IRS.

The flexible leaf member 50 has an arcuate brake pad holder section 60 (FIG. 4) extending from the projecting end 52 toward the connector end 51 with the section 60 designed to encircle a portion of the cylindrical brake pad engaging surface 28 on the end portion of the brake drum 20 as seen in FIG. 2. A similarly shaped flexible brake pad 61 (FIG. 4) is affixed to the inside of the brake pad holder section 60 to frictionally engage the surface 28 on the brake drum. The projecting end 52 of the leaf member 50 is provided with a second connector loop 62 (FIG. 4) for connection to the actuation means 14 as will be explained.

The leaf mounting assembly 41 also includes part of the lateral alignment arrangement 65 that keeps the engaging assembly 11 laterally centered between the side frames SSF. The inwardly facing side edges 66 (FIG. 4) of both the brake pad holder sections 60 and the brake pads 61 form a bearing surface that engages a thrust washer 68 (FIG. 4) fitted into the recess 34 on the transfer section 21 facing the edges 66. This serves to both maintain the brake drum 20 in position laterally of the skate wheel assemblies SWA and keep the brake drum from falling out from between the side frames SSF. The thrust washer 68 has a planar annular flange 69 (FIG. 4) forming the plane of the washer which bears against the side of the transfer section 21 in the recess 34 and an annular lip 70 integral with the outside edge of the flange 69 oriented normal to the plane of the flange 69 to help retain the washer 68 in the recess 34 and prevent the brake pad holder section 60 from engaging the transfer roller 21 and damaging it. The lip 70 also helps maintain the shape of the brake pad holder section 60 as it flexes when the braking forces are applied to the brake drum 20 as will become more apparent.

The lateral alignment arrangement 65, then, includes the edges 66 on the brake pads 61 and holder sections 60 that engage the thrust washer 68. The lateral alignment arrangement 65 also includes the inside engaging surfaces IES (FIG. 3) on the side frames SSF that engage the outside surfaces of the leaf members 50. This keeps the outside peripheral surface 32 on the transfer section 21 laterally aligned with the peripheral tire tread GET on the adjacent pair of skate wheel assemblies SWA as seen in FIG. 3.

When an actuation force is applied that forces the projecting ends 52 of the leaf members 50 downwardly, the brake pads 61 are tightened against the peripheral brake pad engaging surfaces 28 on opposite ends of the brake drum 20 to apply braking forces to the brake drum 20 and resist rotation of the brake drum 20. At the same time, the engaging assembly 11 is forced downwardly toward the skate wheel assemblies SWA so that the peripheral surface 32 on the transfer section 21 frictionally engages the peripheral tire treads GET on the two skate wheel assemblies SWA sufficiently for the skate wheel assemblies SWA to rotationally drive the engaging assembly 11. Thus, the braking forces resisting rotation of the engaging assembly 11 are transferred to the skate wheel assemblies SWA to effectively brake the skate wheel assemblies. Because of the flexibility of the leaf members 50, the engaging assembly 11 can shift forwardly or rearwardly in the direction of the skate centerline $AX_{RS}$ until the braking forces are equally divided between the pair of skate wheel assemblies SWA. Thus, this arrangement is not only automatically compensating for skate wheel tire and transfer roller wear as well as wheel assembly out-of-roundness, it also insures equal division of the braking forces between the skate wheel assemblies being braked. By dividing the braking forces between two skate wheel assemblies, larger braking forces can be applied without sliding the skate wheel assemblies on the ground and also excessively loading either of the skate wheel assemblies so as to extend the life of the skate wheel tires. This also reduces the wear to the transfer section 21 by reducing the frictional force level to be applied at a single point on the transfer section periphery.

The actuation means 14 is illustrated as being driven by the pivotal cuff PSC on the skate IRS in FIG. 1, however, it is to be understood that various arrangements may be utilized to provide the actuation forces necessary to operate the braking means 15. Examples of alternate actuation means are hand held actuation devices; ground engaging pads or rollers attached to the skate itself; and cables connecting the cuff PSC to the leaf members 50.

The actuation means 14 illustrated in FIGS. 1 and 2 includes a motion multiplying pivot assembly 75 mounted on an extension 76 projecting out behind the side frames SSF at the upper rear ends thereof and connected to the connector loops 62 on the projecting ends 52 on the leaf members 50 through a dual rod linkage 78 best seen in FIG. 2. The motion multiplying pivot assembly 75 is connected to the lower rear portion of the pivotal cuff PSC by an adjustable rod linkage 79 as seen in FIGS. 1 and 2. When the cuff PSC is pivoted in a counterclockwise direction as seen in FIG. 1, the braking forces will be applied to the skate wheel assemblies SWA.

The motion multiplying pivot assembly 75 includes a pair of drive links 81 pivotally mounted at one of their ends on pivot pin 82 extending through the upper projecting end of the extension 76 and pivotally mounting one end of the dual rod linkage 78 at the opposite ends thereof. One end of the adjustable rod linkage 79 is pivotally connected to the links 81 intermediate their ends so that the amount of movement imparted to the links 81 by the linkage 79 will be multiplied to the linkage 78.

The dual rod linkage 78 includes a pair of drive rods 95, one connecting the projecting end of one of the drive links 81 to one of the connector loops 62 on the end of the leaf members 50 while the other connects the projecting end of the other drive link 81 to the other connector loop 62 on the end of the other leaf member 50. The diameters of the rods 95 are such that they will just fit between the outside of the leaf members 50 and the side frames SSF when connected to the connector loops 62 on the ends of the leaf members 50 as seem in FIG. 3. This maintains the connections between drive rods 95, the drive links 81 and the leaf members 50.

The limit means 16 includes a limit roller 96 rotatably mounted on the pivot pin 55 between the connectors 54 of the leaf members 50 as best seen in FIGS. 2 and 3. The limit roller 96 is sized to clear the tires SWT on the skate wheel assemblies SWA but to prevent the engaging assembly 11 from passing down between the tires SWT in the event one of the tires SWT becomes deflated or the tires SWT are sufficiently deformed by the downward forces on the drum 20. The roller 96 is also sized to cause the engaging assembly to still apply braking forces to the tire SWT remaining inflated for safety.

The temperature control means 18 serves to dissipate the heat generated at the frictional interface between the brake pads 61 and the brake drum 20 and to thermally isolate the brake drum 20 from the skate wheel assemblies SWA. The thermal isolation of the brake drum 20 from the skate wheel assemblies SWA is provided by the heat flow restriction capability of the spacer portion 31 of transfer section 21 as explained above. A certain portion of the heat generated by braking is transferred to the air flowing through the skate wheel area of the skate by the exposed surfaces of the leaf members 50 while additional heat dissipation is provided by air flow openings 98 through the side frames SSF in alignment with the opening through the brake drum 20 as best seen in FIGS. 1–3 to allow air to flow through the passage 24 of the brake drum 20.

What is claimed as invention is:

1. A mechanism for engaging a first rotating member and a second rotating member, said first rotating member being configured to rotate about a first rotational axis and said second rotating member being configured to rotate about a second rotational axis, said first and second rotating members each having a peripheral surface, and said first rotational axis being spaced apart from and substantially parallel to said second rotational axis, said mechanism configured for engaging said first rotating member along said peripheral surface of said first rotating member and for engaging said second rotating member along said peripheral surface of said second rotating member, said mechanism comprising:

an engaging assembly having a central axis passing through said engaging assembly, said engaging assembly defining a braking member engaging portion, and said engaging assembly further including a peripheral rotating member engaging surface encircling said central axis, said peripheral rotating member engaging surface having a diameter greater than a minimum distance between the peripheries of said first and second rotating members, said rotating member engaging surface being adapted to frictionally engage the peripheries of said first and second rotating members when said first rotating member is rotating and when said second rotating member is substantially at rest so that when said engaging assembly engages said first and second rotating members, said first rotating member rotates said engaging assembly, and said engaging assembly, in turn, rotates said second rotating member;

a mounting apparatus for mounting said engaging assembly so that said engaging assembly is adjacent said peripheries of said first and second rotating members and so that said engaging assembly is free to move a limited distance toward or away from said first and second rotating members while said central axis is maintained generally parallel to said rotational axes of said first and second rotating members;

an actuation member, adjacent said engaging assembly, for selectively forcing said engaging assembly toward said first and second rotating members; and a braking member, adjacent said engaging assembly, for applying a braking force to said braking member engaging portion of said engaging assembly so that said engaging assembly retards the rotation of said first rotating member after said actuation member forces said engaging assembly toward said first and second rotating members.

2. The mechanism of claim 1, wherein said second rotating member is a passive roller.

3. The mechanism of claim 1, wherein said braking member is disposed on said mounting apparatus.

4. A mechanism for engaging a rotating member, said mechanism comprising:

an engaging assembly having a rotating member engaging portion and a braking member engaging portion, said braking member engaging portion being adjacent to said rotating member engaging portion;

a flexible braking member, said flexible braking member having a curved portion substantially forming the shape of a major arc, said major arc having a central angle greater than 180 degrees, said flexible braking member being configured to be moved from a first configuration into a second configuration, a diameter of said curved portion in said first configuration being greater than a diameter of said curved portion in said second configuration, and a central angle of said curved portion in said first configuration being less than a central angle of said braking member in said second configuration; and an actuation apparatus for moving said braking member from said first configuration into said second configuration;

wherein when said braking member is moved from said first configuration into said second configuration, said braking member exerts a force on said engaging assembly, said force being sufficient to move said engaging assembly from a first position in which said engaging assembly does not engage said rotating member, to a second position in which said rotating member engaging portion of said engaging assembly engages a periphery of said rotating member.

5. The mechanism of claim 4, wherein said braking member captures said engaging assembly when said braking member is in said second configuration.

6. The mechanism of claim 4, wherein said force is sufficient to maintain said engaging assembly in frictional contact with said rotating member so that rotation of said rotating member is inhibited.

7. The mechanism of claim 4, wherein, when said braking member is in said second position, said braking member exerts braking forces on said engaging assembly in a first direction and simultaneously exerts braking forces on said engaging assembly in a second direction opposite said first direction.

8. The mechanism of claim 4, wherein, when said braking member is in said first position, said braking member exerts upward forces on said engaging assembly.

9. The mechanism of claim 4, wherein said actuation apparatus is operative to move a portion of said braking member along a line that is tangential to said braking member engaging portion of said engaging assembly.

10. The mechanism of claim 4, wherein said braking member engaging portion is substantially cylindrical.

11. The mechanism of claim 4, wherein said mechanism includes two braking member engaging portions and two braking members.

12. The mechanism of claim 4, wherein said rotating member is a first rotating member and said mechanism is configured so that said engaging assembly may engage a second rotating member at the same time that said engaging assembly engages said first rotating member.

13. The mechanism of claim 4, wherein said engaging assembly is configured for engaging said first rotating member along a line defined by a center-point of said first rotating member and a center-point of said engaging assembly while simultaneously engaging said second rotating member along a line defined by a center-point of said second rotating member and a center-point of said engaging assembly.

14. The mechanism of claim 8, wherein said upward forces are sufficient to support the entire weight of said engaging assembly.

15. The mechanism of claim 14, wherein, when said braking member is in said second position, said braking member exerts forces on said engaging assembly that are sufficient to maintain said engaging assembly in said second position.

16. The mechanism of claim 10, wherein said rotating member engaging portion is substantially cylindrical.

17. The mechanism of claim 16, wherein said rotating member engaging portion and said braking member engaging portion are concentric.

18. The mechanism of claim 17, wherein the radius of said rotating member engaging portion is greater than the radius of said braking member engaging portion.

19. The mechanism of claim 18, wherein said mechanism further includes heat flow restricting means for limiting heat transfer from said braking member engaging portion to said rotating member engaging portion.

20. The mechanism of claim 11, wherein said two braking member engaging portions are on opposite sides of said rotating member engaging portion.

21. The mechanism of claim 20, wherein said diameter of said first braking member engaging portion is approximately the same as the diameter of said second braking member engaging portion.

22. The mechanism of claim 20, wherein said two braking members and said engaging assembly have a common central axis.

23. The mechanism of claim 12, wherein said second rotating member is a passive roller.

24. The mechanism of claim 12, wherein said engaging assembly is adapted to frictionally engage the peripheries of said first and second rotating members when said first rotating member is rotating and when said second rotating member is substantially at rest so that when said engaging assembly engages said first and second rotating members, said first rotating member rotates said engaging assembly and said engaging assembly, in turn, rotates said second rotating member.

25. A braking mechanism for an in-line roller skate used on a skating surface, said roller skate including a pair of side frames and at least two adjacent skate wheel assemblies rotatably mounted between said side frames about parallel skate wheel rotational axes so that said skate wheel assemblies are generally aligned along a common straight path and spaced apart a prescribed wheel spacing distance, said braking mechanism comprising:

an engaging assembly defining a central axis that passes through said engaging assembly, said engaging assembly further defining a generally cylindrical peripheral skate wheel engaging surface encircling said central axis, said skate wheel engaging surface having a diameter greater than the minimum distance between the peripheries of two of said adjacent skate wheel assemblies, said skate wheel engaging surface being adapted to frictionally engage said peripheries of said two adjacent skate wheel assemblies so that said engaging assembly is drivingly rotated by said two adjacent skate wheel assemblies when said engaging assembly is frictionally engaging said two adjacent skate wheel assemblies;

means for selectively moving said engaging assembly toward said peripheries of said two adjacent skate wheel assemblies so that said engaging assembly frictionally engages said peripheries of said two adjacent skate wheel assemblies and is rotated thereby while the contact forces between said engaging assembly and said two adjacent skate wheel assemblies are substantially equalized; and means for applying a braking force to said engaging assembly so that said engaging assembly retards the rotation of said two adjacent skate wheel assemblies while said engaging assembly is frictionally engaging said peripheries of said two adjacent skate wheel assemblies, said means firther including secondary means for limiting the movement of said engaging assembly toward one or both of said two adjacent skate wheel assemblies to prevent said engaging assembly from passing between said two adjacent skate wheel assemblies, at least a portion of said secondary means being disposed between said two adjacent skate wheel assemblies, and beneath said engaging assembly.

26. The braking mechanism of claim 25, wherein said secondary means comprises limit means for contacting said engaging assembly to limit the movement thereof toward one or both of said two adjacent skate wheel assemblies.

27. An in-line roller skate adapted to be worn on the feet of a user for skating on a skating surface, said in-line roller skate comprising:

a skate shoe adapted to be worn on the foot of the user, said skate shoe defining a bottom thereon and a common longitudinally extending generally vertical plane therethrough;

a frame assembly attached to said bottom of said skate shoe and comprising a pair of spaced apart side frame members depending below said skate shoe and equidistantly spaced on opposite sides of said common vertical plane;

at least two adjacent skate wheel and tire assemblies rotatably mounted at spaced apart positions between said side frame members about rotational axes generally normal to said common vertical plane, said rotational axes lying in a common generally horizontal plane normal to said common vertical plane and spaced apart a prescribed skate wheel and tire assembly spacing distance whereby said roller skate moves along a prescribed linear path generally aligned with said common vertical plane as said skate wheel and tire assemblies roll over said skating surface;

an engaging assembly defining a central axis that passes through said engaging assembly, said engaging assembly further defining a generally cylindrical peripheral skate wheel engaging surface encircling said central axis, said skate wheel engaging surface having a diameter greater than the minimum distance between the peripheries of two of said adjacent skate wheel and tire assemblies, said skate wheel engaging surface adapted to frictionally engage said peripheries of said two adjacent skate wheel and tire assemblies so that said engaging assembly is drivingly rotated by said two adjacent skate wheel and tire assemblies when said engaging assembly is frictionally engaging said two adjacent skate wheel and tire assemblies; and, means for selectively moving said engaging assembly toward said peripheries of said two adjacent skate wheel and tire assemblies so that said engaging assembly frictionally engages said peripheries of said two adjacent skate wheel and tire assemblies and is rotated thereby while the contact forces between said engaging assembly and said two adjacent skate wheel and tire assemblies are maintained substantially equalized while said two adjacent skate wheel and tire assemblies remain at about the same diameter; and means for applying a braking force to said engaging assembly so that said engaging assembly retards the rotation of said two adjacent skate wheel and tire assemblies while said engaging assembly is frictionally engaging said two adjacent skate wheel and tire assemblies, said means further including secondary means for limiting the movement of said engaging assembly toward one or both of said two adjacent skate wheel and tire assemblies to prevent said engaging assembly from passing between said two adjacent skate wheel and tire assemblies, at least a portion of said secondary means being disposed between said two adjacent skate wheel and tire assemblies, and beneath said engaging assembly.

28. The in-line skate of claim 27, wherein said secondary means is constructed and arranged to maintain frictional driving contact between said adjacent skate wheel and tire assemblies so that said engaging assembly continues to apply braking forces to said two adjacent skate wheel and tire assemblies while limiting the movement of said engaging assembly.

29. A braking mechanism for an in-line roller skate used on a skating surface, said roller skate including a pair of side frames and a plurality of skate wheel and tire assemblies equipped with pneumatic tires rotatably mounted between said side frames about parallel skate wheel rotational axes spaced apart a prescribed wheel spacing distance so that said skate wheel and tire assemblies are generally aligned along a common straight path and so that said peripheral surfaces of an adjacent two of said pneumatic tires define a minimum clearance distance between said pneumatic tires when said pneumatic tires are inflated, said braking mechanism comprising:

an engaging assembly defining a central axis through said engaging assembly, said engaging assembly further defining a generally cylindrical peripheral pneumatic tire engaging surface encircling said central axis, said pneumatic tire engaging surface having a diameter greater than said minimum clearance distance, said pneumatic tire engaging surface adapted to frictionally engage the peripheries of said two adjacent pneumatic tires so that said engaging assembly is drivingly rotated by said two adjacent pneumatic tires when said engaging assembly is frictionally engaging said two adjacent pneumatic tires; and, means for selectively moving said engaging assembly toward said peripheries of said two adjacent pneumatic tires so that said engaging assembly frictionally engages said peripheries of said two adjacent pneumatic tires and is rotated thereby while the contact forces between said engaging assembly and said two adjacent pneumatic tires are substantially equal; and means for applying a braking force to said engaging assembly so that said engaging assembly retards the rotation of said two adjacent pneumatic tires while said engaging assembly is frictionally engaging said two adjacent pneumatic tires, said means further constructed and arranged to apply braking forces to said two adjacent pneumatic tires when one of said two adjacent pneumatic tires is deflated.

30. A method of braking a pair of spaced apart rotating skate wheel assemblies on in-line roller skates, said skate wheel assemblies being rotatable about generally parallel, spaced apart axes and equipped with resilient tires comprising the steps of:

(a) providing an engaging assembly, said engaging assembly defining a central axis through said engaging assembly and said engaging assembly further defining a generally cylindrical peripheral skate wheel engaging surface encircling said central axis;

(b) providing a limiting member, at least a portion of which is disposed between said pair of rotating skate wheel assemblies and beneath said engaging assembly, said limiting member being configured for preventing said engaging assembly from passing between said pair of rotating skate wheel assemblies;

(c) rotatably positioning said engaging assembly between said rotating skate wheel assemblies so that said skate wheel engaging surface is in peripheral contact with said resilient tires on both of said pair of rotating skate wheel assemblies;

(d) restraining said engaging assembly so that said engaging assembly is maintained in lateral alignment with said rotating skate wheel assemblies while being free to move toward and away from said resilient tires on said rotating skate wheel assemblies;

(e) moving said engaging assembly toward said resilient tires on said rotating skate wheel assemblies so that said engaging assembly exerts substantially equal forces on said rotating skate wheel assemblies; and, (f) applying braking forces to said engaging assembly to resist said rotation of said engaging assembly so that substantially equally divided braking forces are applied to said rotating skate wheel assemblies.

31. The method of claim 30 further comprising the step of:

(f) physically limiting the movement of said engaging assembly toward one or more of said resilient tires on said rotating skate wheel assemblies so as to prevent said engaging assembly from passing between said resilient tires.

32. The method of claim 30, wherein said limiting member is a limiting roller.

* * * * *